US007850015B1

(12) United States Patent
Mason

(10) Patent No.: US 7,850,015 B1
(45) Date of Patent: Dec. 14, 2010

(54) DISPLAY DEVICE FOR TUBULAR ITEMS

(75) Inventor: Timothy L. Mason, Melville, NY (US)

(73) Assignee: New Dimensions Research Corporation, Melville, NY (US)

( * ) Notice: Subject to any disclaimer, the term of this patent is extended or adjusted under 35 U.S.C. 154(b) by 324 days.

(21) Appl. No.: 12/006,503

(22) Filed: Jan. 3, 2008

Related U.S. Application Data

(60) Provisional application No. 60/878,710, filed on Jan. 4, 2007.

(51) Int. Cl.
*A47F 1/04* (2006.01)

(52) U.S. Cl. ..... 211/59.2; 211/175; 312/45; 312/73

(58) Field of Classification Search ..... 211/59.2, 211/59.3, 175; 312/45, 60, 61, 73
See application file for complete search history.

(56) References Cited

U.S. PATENT DOCUMENTS

| | | | | | |
|---|---|---|---|---|---|
| 929,910 | A * | 8/1909 | Wood | 70/16 |
| 2,628,875 | A * | 2/1953 | Ossanna, Jr. | 312/45 |
| 2,888,145 | A * | 5/1959 | Knott et al. | 211/59.2 |
| 3,662,898 | A * | 5/1972 | Baxendale | 211/59.2 |
| 4,105,126 | A * | 8/1978 | Deffner et al. | 211/59.2 |
| 4,685,574 | A * | 8/1987 | Young et al. | 211/59.2 |
| 4,852,767 | A * | 8/1989 | Humphrey | 221/241 |
| 4,911,309 | A * | 3/1990 | Stefan | 211/59.2 |
| D342,420 | S * | 12/1993 | Ienna | D6/517 |
| 5,295,596 | A * | 3/1994 | Squitieri | 211/175 |
| 5,788,117 | A * | 8/1998 | Zimmanck | 221/285 |
| 5,865,324 | A * | 2/1999 | Jay et al. | 211/59.2 |
| D459,927 | S * | 7/2002 | Flowers et al. | D6/517 |
| D486,324 | S | 2/2004 | Mason | |
| D489,556 | S | 5/2004 | Mason | |
| D496,193 | S | 9/2004 | Mason | |
| 6,877,618 | B2 | 4/2005 | Mason | |
| D511,426 | S | 11/2005 | Mason | |
| 6,991,116 | B2 * | 1/2006 | Johnson et al. | 211/59.2 |
| 7,124,898 | B2 * | 10/2006 | Richter et al. | 211/59.3 |
| 7,131,543 | B2 | 11/2006 | Mason | |
| 7,249,679 | B2 * | 7/2007 | Klein | 211/37 |
| 7,303,095 | B2 * | 12/2007 | Nagelski et al. | 221/256 |
| 7,458,473 | B1 * | 12/2008 | Mason | 211/59.3 |
| 2004/0200789 | A1 * | 10/2004 | Woodbury | 211/59.2 |
| 2005/0127015 | A1 * | 6/2005 | Medcalf et al. | 211/59.2 |
| 2006/0243683 | A1 * | 11/2006 | Onachilla et al. | 211/59.2 |

(Continued)

*Primary Examiner*—Darnell M Jayne
*Assistant Examiner*—Devin Barnett
(74) *Attorney, Agent, or Firm*—Collard & Roe, P.C.

(57) ABSTRACT

A display device for displaying and dispensing tubular items of merchandise includes a first side and a substantially parallel second side spaced apart by a distance. A base forming a bottom portion and a cover forming a top portion of the display device are disposed between the first and second side. A first ramp having a first width is disposed between the first and second side and slopes downwardly toward a rear portion of the display device. A second ramp having a second width is disposed between the first and second side. At least a portion of the second ramp is disposed under the first ramp and slopes downwardly toward a front portion of the display device. The first width and second width are less than the distance between the first side and second side for facilitating a movement of the tubular items of merchandise in the display device.

8 Claims, 11 Drawing Sheets

U.S. PATENT DOCUMENTS

2006/0254991 A1* 11/2006 Klein ..... 211/37
2007/0007221 A1* 1/2007 Mann ..... 211/59.3
2007/0278171 A1* 12/2007 Jersey et al. ..... 211/188
2010/0032391 A1* 2/2010 Schneider et al. ..... 211/59.2
2010/0059520 A1* 3/2010 Roeske ..... 220/500

* cited by examiner

DISPLAY DEVICE FOR TUBULAR ITEMS

CROSS REFERENCE TO RELATED APPLICATIONS

This application claims the benefit of U.S. Provisional Application No. 60/878,710 filed on Jan. 4, 2007.

BACKGROUND OF THE INVENTION

1. Field of the Invention

The present invention relates to display devices and more particularly to a display device that is suitable for display of tubular items of merchandise such as cans of shaving cream that permits a plurality of such items to be housed in the display for dispensement one at a time to a consumer.

2. The Prior Art

A wide variety of products are packaged in tubular or cylindrical containers. Many such products, such as shaving cream for example, have a central body portion which is cylindrical, but with one or both ends being non-uniform, for example because a dispenser or the spout for the shaving cream or other product is located at one of the ends.

It would be desirable to provide a display device for such products, wherein one or more sloping ramps are incorporated into the display device for dispensing the products. If such a ramp portions were designed to have a width such that one or both of the non-uniform ends of the product are in contact with the ramp, the risk that the merchandise item would get stuck along the path of the ramp would increase.

Accordingly, there exists a need for a display device for displaying and dispensing tubular items of merchandise, wherein the width of the ramp portions of the display device is such so as to be in contact only with the portion of the tubular or cylindrical item that is uniform, thereby insuring smooth and unbroken movement of the item along the ramp inside the dispenser.

Moreover, retailers sometimes sell products such as shaving cream with additional products at the same price as a bonus or promotion for a particular time. In such cases, the item of merchandise is usually taller than the normal size of the product. In addition, product manufacturers also sell their products in various sizes or different products in different sizes.

Accordingly, there exists a need for a display device for displaying and dispensing tubular items of merchandise, wherein at least a portion of the display device is movable between a retracted position and an expanded position for accommodating a plurality of sizes of merchandise.

SUMMARY OF THE INVENTION

The invention relates to display devices and more particularly to a display device that is suitable for display of tubular items of merchandise such as cans of shaving cream that permits a plurality of such items to be housed in the display for dispensement one at a time to a consumer.

In one aspect of the invention, a display device for displaying and dispensing tubular items of merchandise includes a first side and a second side arranged substantially parallel to the first side and spaced apart from the first side by a distance.

A base is disposed between the first and second sides, forming a bottom portion of the display device. A cover is disposed between the first and second sides, forming a top portion of the display device.

A first ramp having a first width is disposed between the first side and the second side. The first ramp slopes downwardly toward a rear portion of the display device. A second ramp having a second width is disposed between the first side and the second side. At least a portion of the second ramp is disposed under the first ramp and slopes downwardly toward a front portion of the display device.

Each of the first width of the first ramp and the second width of the second ramp are less than the distance between the first side and the second side for facilitating a movement of the tubular items of merchandise in the display device.

In another aspect of the invention, one or both of the first side and the second side are movable between a retracted position and an expanded position for accommodating a plurality of sizes of the tubular items of merchandise.

In a further aspect of the invention, a display device for displaying and dispensing tubular items of merchandise includes a sliding member comprising an elongated rod projecting outwardly from a first side and/or a second side of the display device and a sleeve adapted to receive the sliding member. The sliding member is laterally movable in the sleeve for moving the first side or second side between the retracted and expanded positions.

One advantage of a display device for displaying and dispensing tubular items of merchandise according to an embodiment of the invention that a display device is provided which includes ramps, wherein the width of the ramp portions of the display device is such so as to be in contact only with the portion of the tubular or cylindrical item that is uniform. This arrangement facilitates a movement of the tubular item of merchandise in the display device, thereby insuring smooth and unbroken movement of the item along the ramp inside the dispenser.

A further advantage of a display device according to an embodiment of the invention is that at least a portion of the display device may be movable between a retracted position and an expanded position for accommodating a plurality of sizes of merchandise.

Another advantage of a display device according to an embodiment of the invention is that one or more sliding members and one or more associated sleeves may be provided, wherein the sliding members are laterally movable in the associated sleeves for moving one or both sides of the display device between the retracted and expanded position. The sliding members may be provided with stops which can engage projections on the sleeves to selectively limit the lateral movement of the sliding members.

BRIEF DESCRIPTION OF THE DRAWINGS

Other benefits and features of the present invention will become apparent from the following detailed description considered in connection with the accompanying drawings. It is to be understood, however, that the drawings are designed as an illustration only and not as a definition of the limits of the invention.

In the drawings, wherein similar reference characters denote similar elements throughout the several views.

DETAILED DESCRIPTION OF THE DRAWINGS

Figure 1:
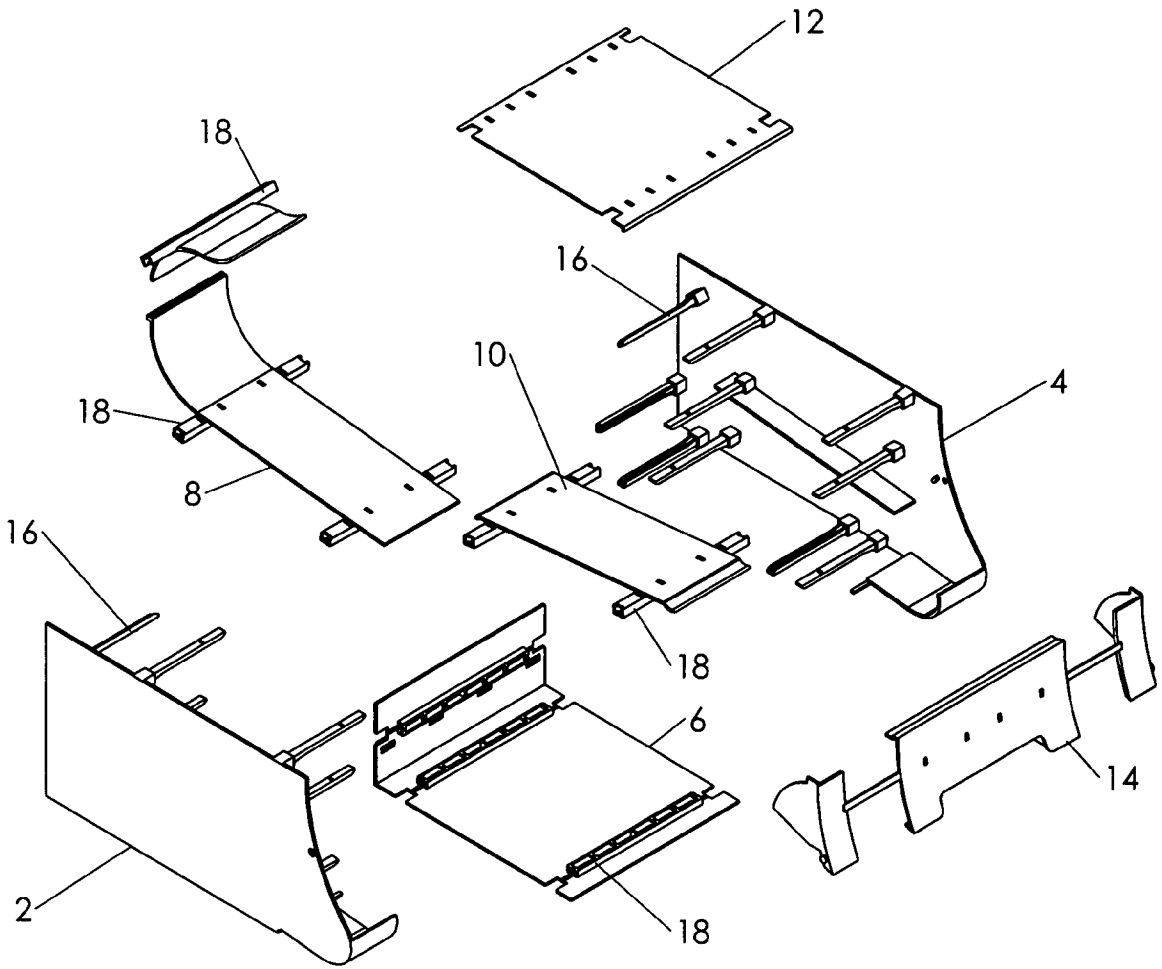
FIG. 1 shows an exploded view of an embodiment of a display device in accordance with the invention.
Figure 2:
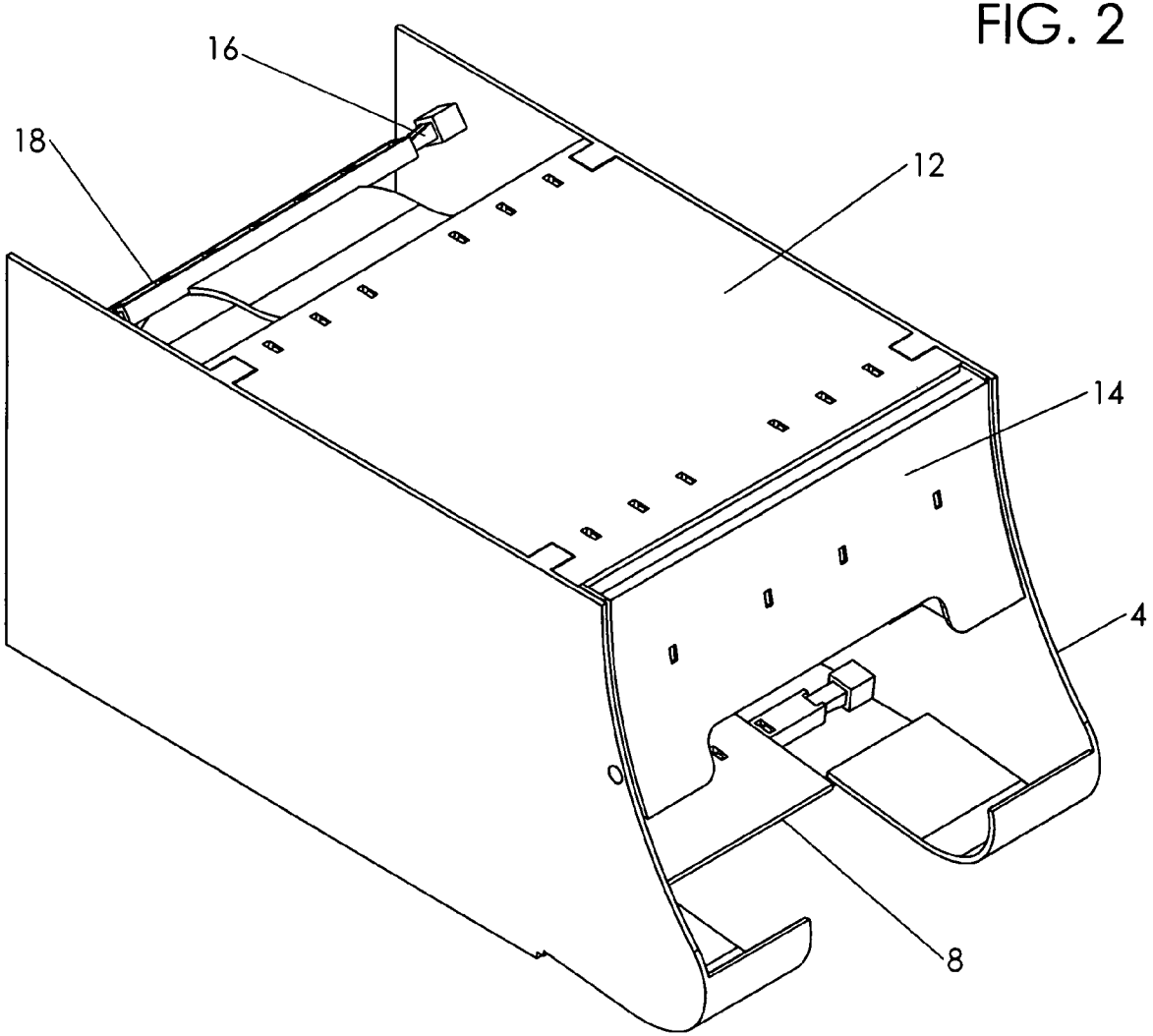
FIG. 2 shows a perspective view of the display device of FIG. 1 in assembled form with the sides of the display device retracted for housing shorter products.

FIG. 1 shows an exploded view of an embodiment of a display device for displaying and dispensing tubular or cylindrical items of merchandise in accordance with the invention. As shown, the display device includes a first side 2 and a second side 4. Second side 4 is arranged substantially parallel to first side 2 and is spaced apart from first side 2. As shown, a lower front portion of sides 2, 4 may form a dispensing area where the merchandise item can be removed by a purchaser or prospective purchaser.

A base 6 is disposed between first side 2 and second side 4. Base 6 forms a bottom portion of the display device. Base 6 may comprise a substantially flat horizontal member or panel and may also include a portion oriented substantially perpendicular to the bottom portion of the display device defining a rear portion of the display device.

A cover 12 is disposed between first side 2 and second side 4. Cover 12 forms a top portion of the display device. Cover 12 may comprise a substantially flat horizontal member or panel.

Sides 2, 4, base 6 and cover 12 may be constructed from any suitable material such as for example, sheet metal or plastics, or any combination thereof. Additionally a drawer or door 14 may be provided to facilitate the loading of merchandise items into the display device. Drawer 14 may be pivotally mounted on sides 2, 4 to allow drawer 14 to be pulled forward for loading of tubular or cylindrical merchandise items. Drawer 14 may be movable between a closed position and an open position for loading the tubular items of merchandise into the display device.

The display device includes a series of ramps for guiding the tubular items of merchandise through the display device and to the dispensing area. The ramps are arranged so the merchandise items can roll down a ramp under the influence of gravity. Preferably, as one item of merchandise is removed from a front or dispensing portion of the display device, the remaining items in the display device, guided by the ramps, roll toward the front or dispensing portion of the display device so that the next item is positioned for dispensing.

In particular, a first ramp 10 is disposed between first side 2 and second side 4 of the dispensing device. First ramp 10 has a first width and slopes downwardly toward a rear portion of the display device.

Figure 4:
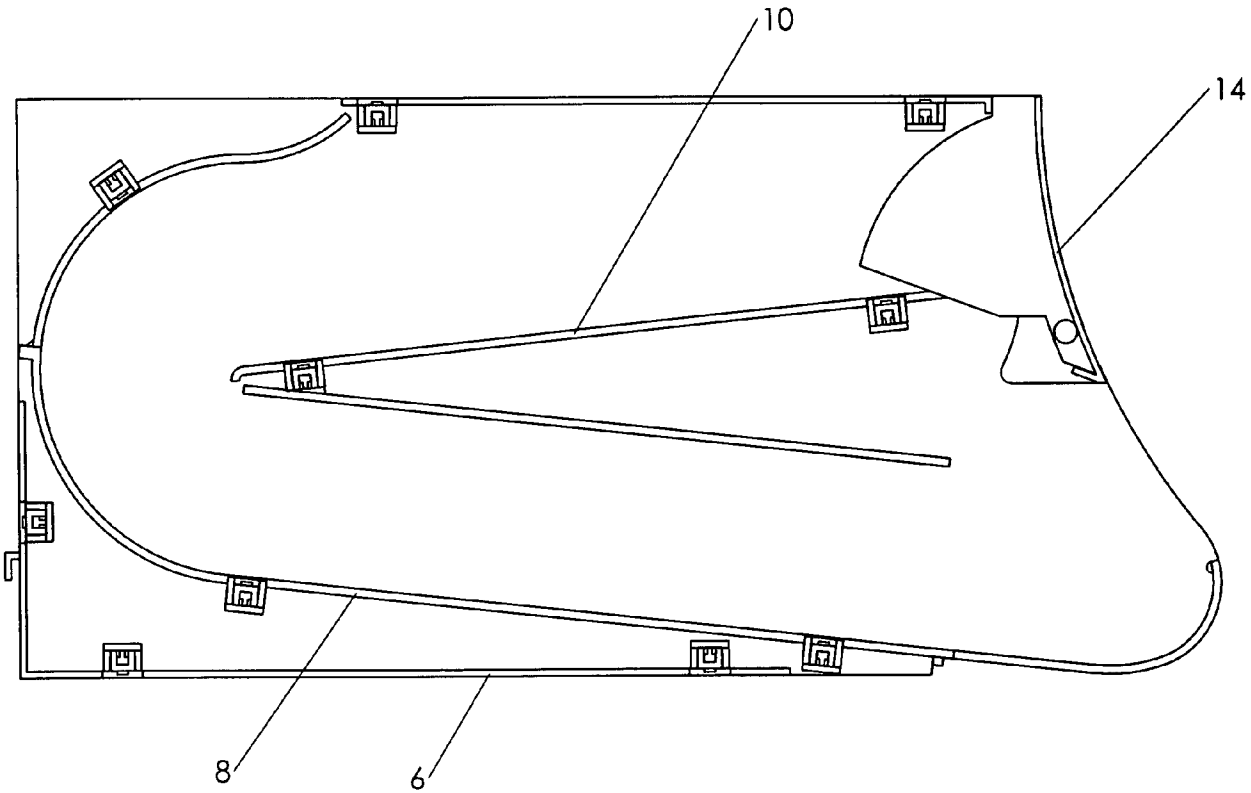
FIG. 4 shows the embodiment of FIGS. 1-3 in a side view to show the path of a tubular merchandise item placed within the display device.

A second ramp 8 is disposed between first side 2 and second side 4 and has a second width. At least a portion of second ramp 8 is disposed under first ramp 1 and slopes downwardly toward a front portion of the display device. As best shown in FIG. 4, first ramp 10 and second ramp 8 are arranged so that the tubular items of merchandise can roll down first ramp 10 toward a rear portion of the display device, wherein the items roll off first ramp 10 onto second ramp 8. The items may be guided by a curved portion of second ramp 8 and proceed to roll toward a front dispensing portion of the display device.

Each of first width of first ramp 10 and the second width of second ramp 8 is less than the distance between first side 2 and second side 4 for facilitating a movement of the tubular items of merchandise in the display device. In particular the widths of ramp portions 8,10 are such so as to be in contact only with the portion of the tubular or cylindrical item that is uniform, thereby insuring smooth and unbroken movement of the item along the ramps inside the dispenser. This arrangement reduces or eliminates the risk of the merchandise item becoming stuck along the path of the ramps.

Figure 3:
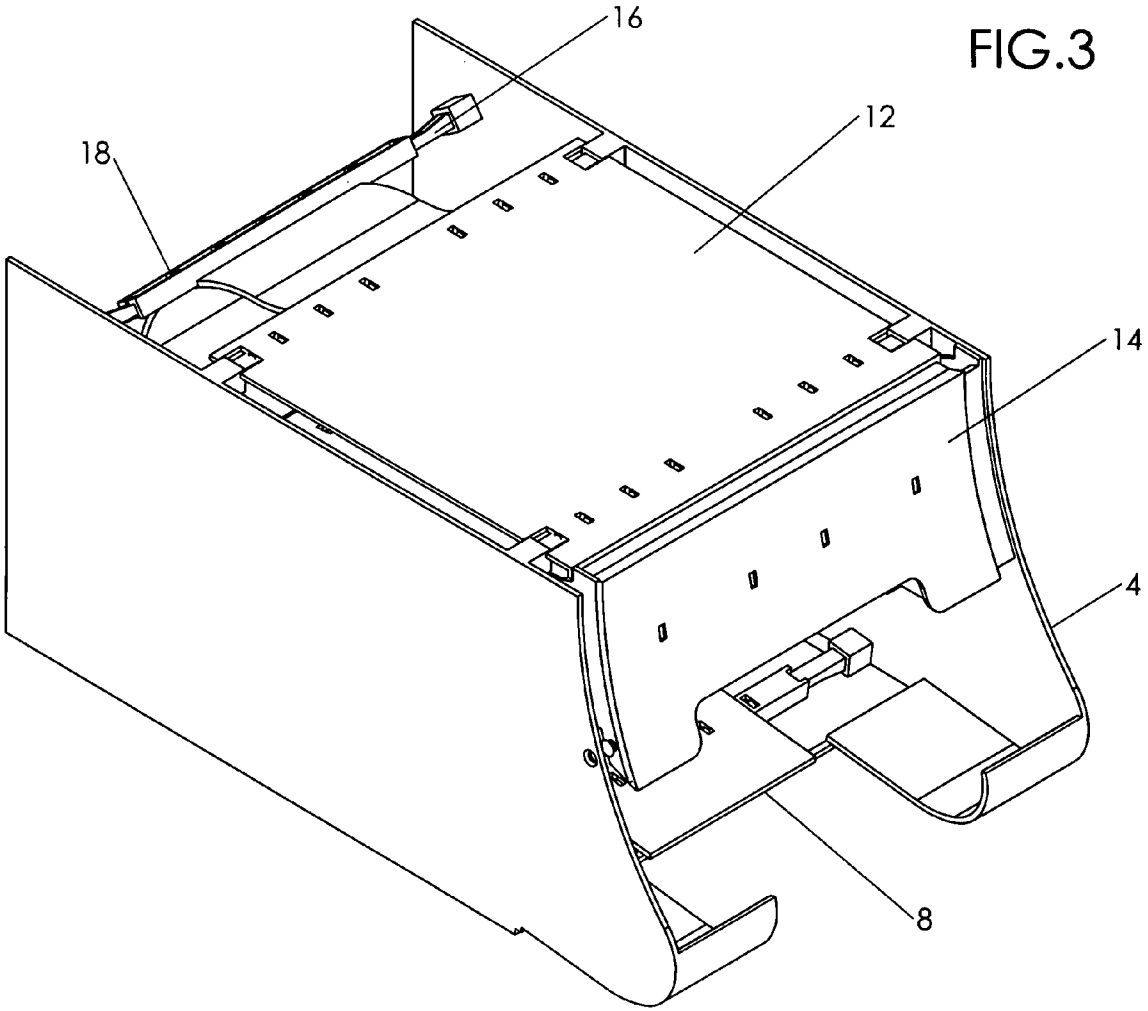
FIG. 3 is a view similar to FIG. 2 but shows the sides of the display device pulled out or expanded position to accommodate taller products.
Figure 5:
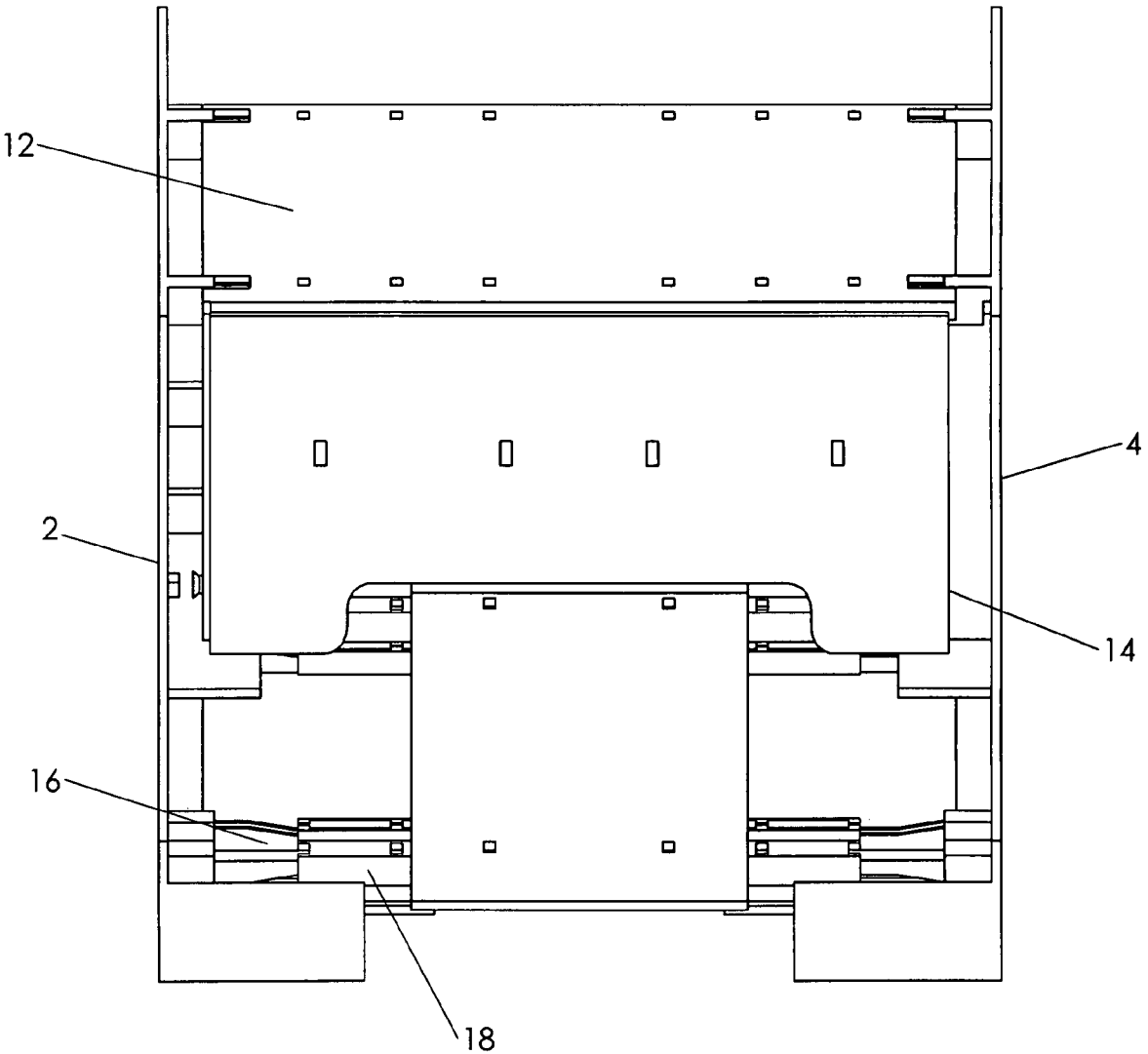
FIG. 5 shows a front view of the embodiment of FIGS. 1-4 with the sides of the display device in an expanded position similar to FIG. 3.
Figure 6:
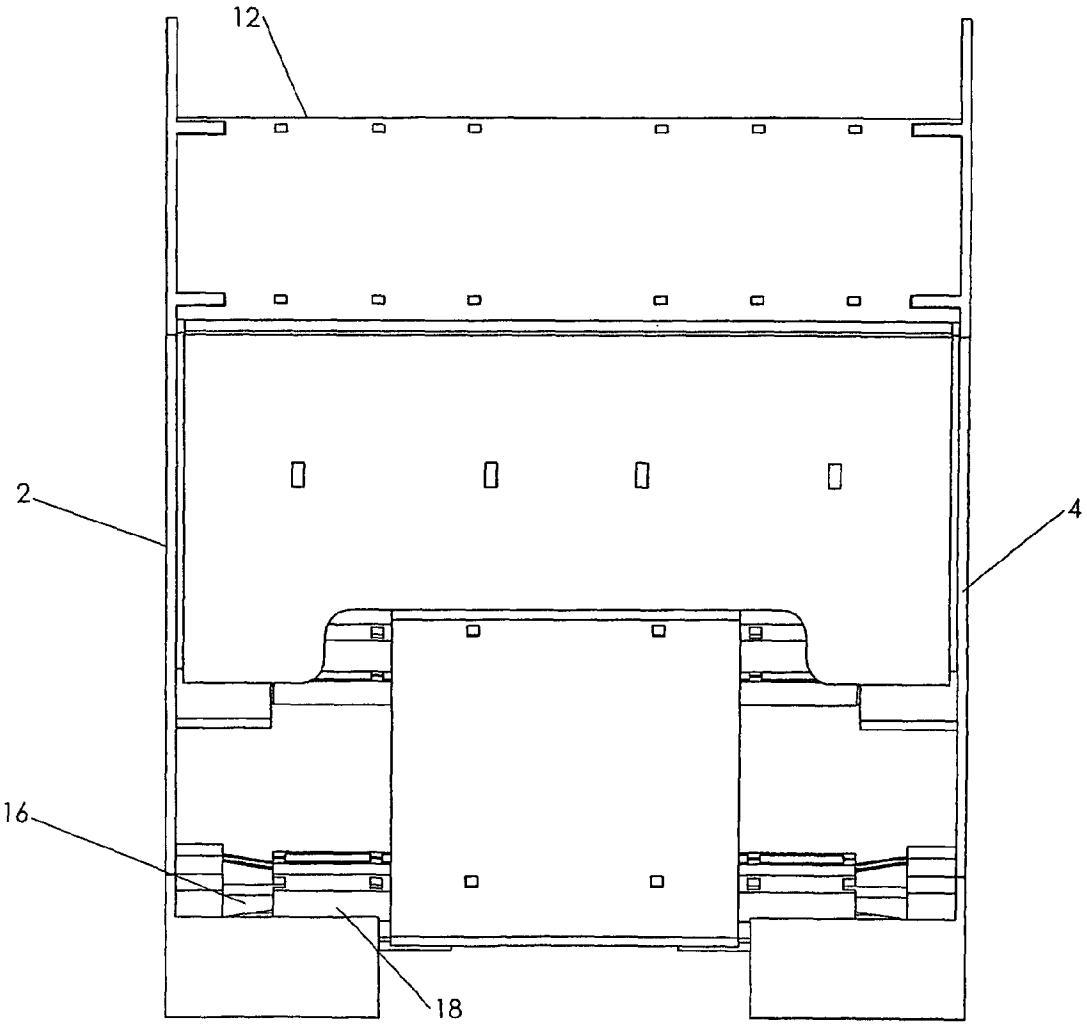
FIG. 6 shows a view similar to FIG. 5 but with the sides of the display device in a retracted position similar to FIG. 2.
Figure 7:
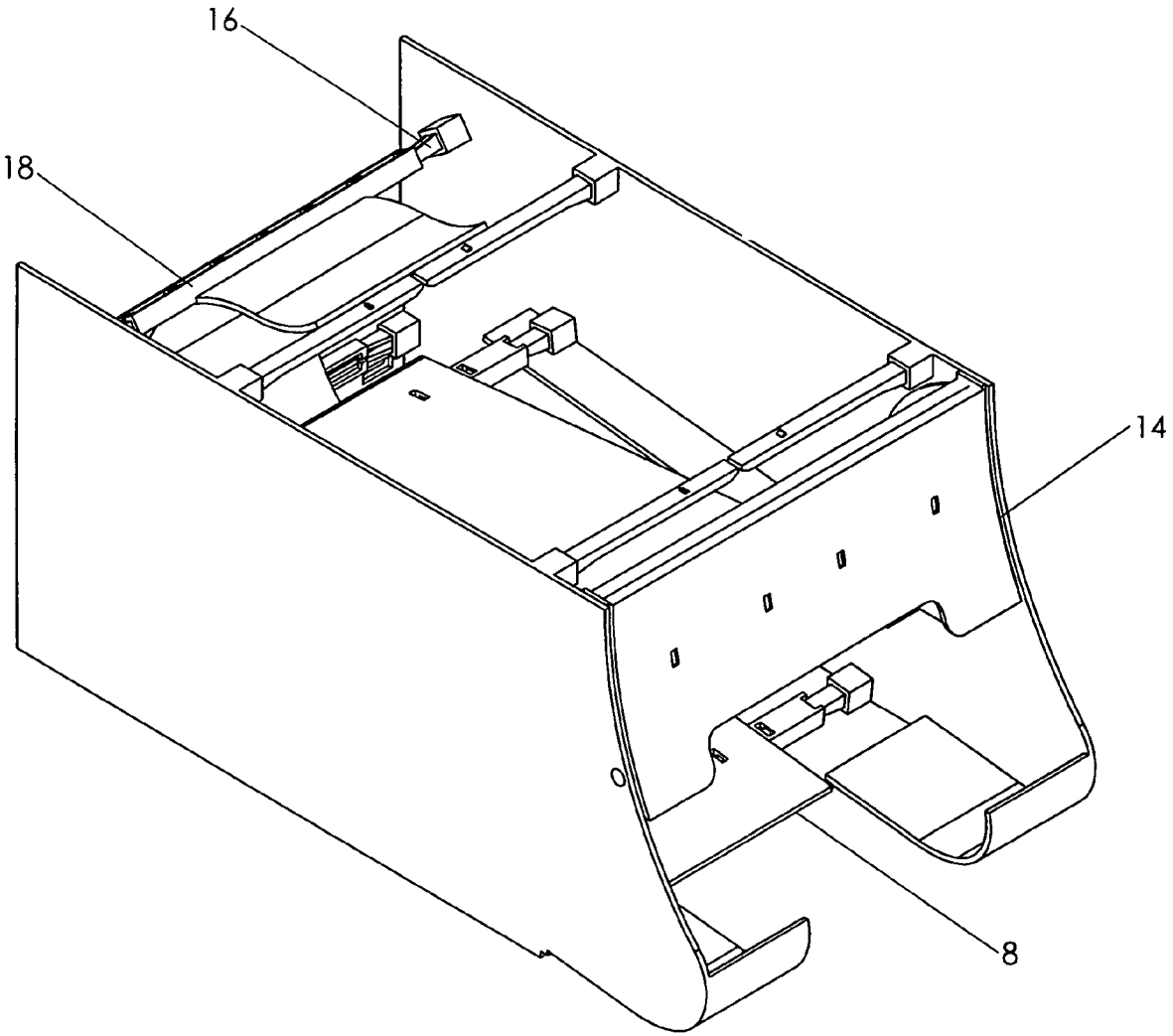
FIG. 7 is a view similar to FIG. 2 but with the top of the display device cut away to show the interior thereof.

As shown, for example in FIGS. 2, 3, 5 and 6, in a display device according to the invention one or both of first side 2 and second side 4 may be movable between a retracted position (as shown, for example in FIGS. 2 and 6) and an expanded position (as shown, for example in FIGS. 3 and 5). This feature allows the display device to accommodate a plurality of sizes of the tubular items of merchandise.

As set forth above, each of the first width of first ramp 10 and the second width of second ramp 8 is less than the distance between first side 2 and second side 4 for facilitating a movement of the tubular items of merchandise in the display device. In particular, a ratio of a width of first ramp 10 to the distance between first side 2 and second side 4 and a ratio between a width of second ramp 8 to the distance between first side 2 and second side 4 may each be in the range of approximately 0.2-1.0 to 0.8-1.0 when the display device is in the retracted position. More particularly, a ratio of a width of first ramp 10 to the distance between first side 2 and second side 4 and a ratio between a width of second ramp 8 to the distance between first side 2 and second side 4 may each be in the range of approximately 0.4-1.0 to 0.6-1.0 when the display device is in the retracted position.

When the display device is in its expanded position, as shown, for example in FIGS. 3 and 5, a ratio of a width of first ramp 10 to the distance between first side 2 and second side 4 and a ratio between a width of second ramp 8 to the distance between first side 2 and second side 4 may each be in the range of approximately 0.1-1.0 to 0.6-1.0. More particularly, a ratio of a width of first ramp 10 to the distance between first side 2 and second side 4 and a ratio between a width of second ramp 8 to the distance between first side 2 and second side 4 may each be in the range of approximately 0.3-1.0 to 0.5-1.0 when the display device is in the expanded position.

In order to accommodate a plurality of sizes of tubular products by allowing first side 2 and/or second side 4 to move between expanded and retracted positions, a sliding member 16 comprising an elongated rod projects outwardly from first side 2 and/or second side 4. A sleeve 18 is adapted to receive sliding member 16 and sliding member 16 is laterally movable in sleeve 18 for moving first side 2 and/or second side 4 between the retracted and expanded positions.

As shown, for example in FIG. 1, a first plurality of sliding members 16 may be disposed on first side 2 of the display device and a second plurality of sliding members 16 may be disposed on second side 4 of the display device. A plurality of sleeves 18 may be provided and disposed on one or more of base 6, cover 12, first ramp 10 and/or second ramp 8.

Corresponding sliding members 16 associated with first side 2 and second side 4 may form sliding member pairs, wherein a sliding member 16 associated with first side 2 and a sliding member 16 associated with second side 4 are received in an associated sleeve of the plurality of sleeves.

Figure 8:
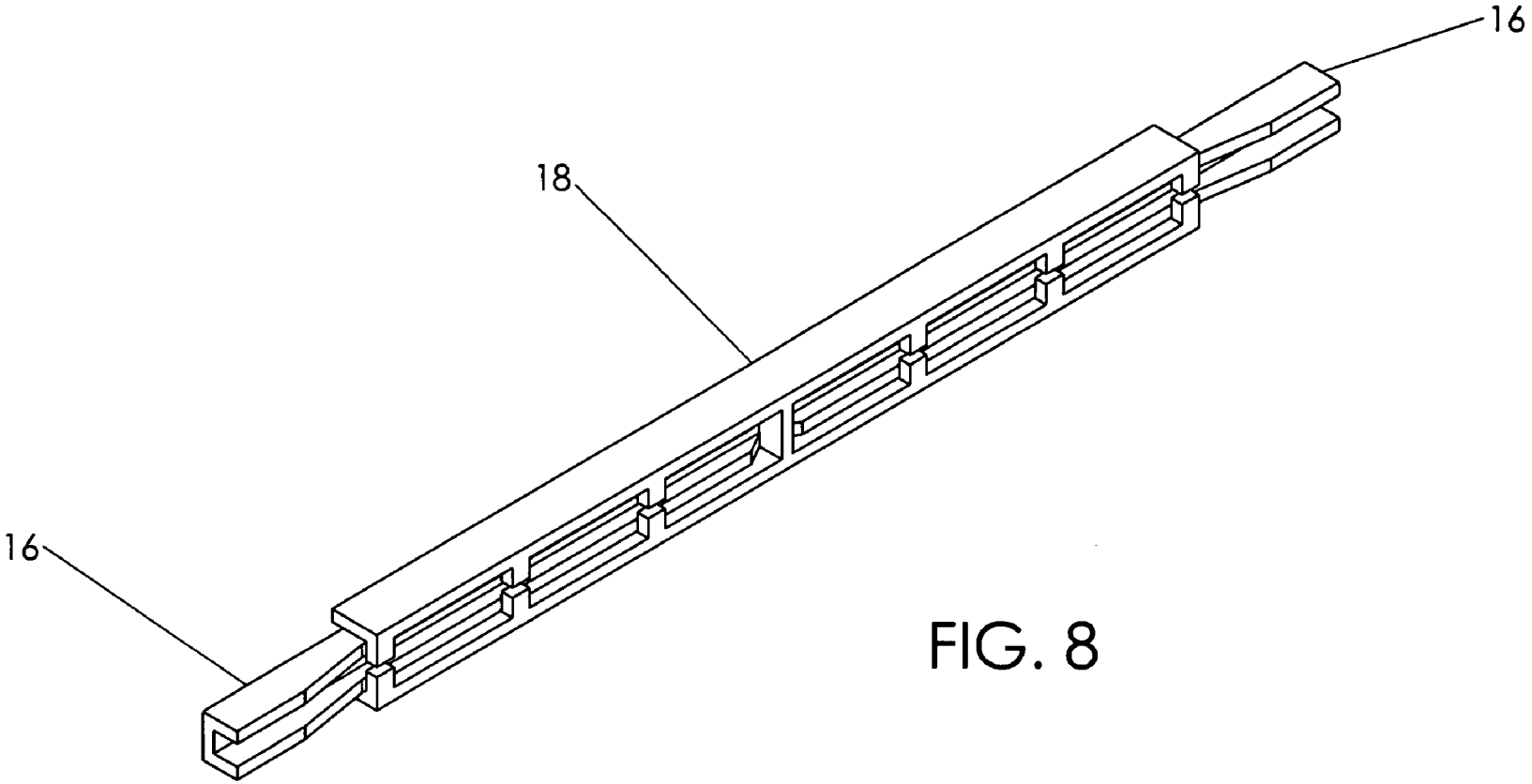
FIG. 8 shows an expanding and contracting mechanism used in the embodiment of FIGS. 1-7.
Figure 9:
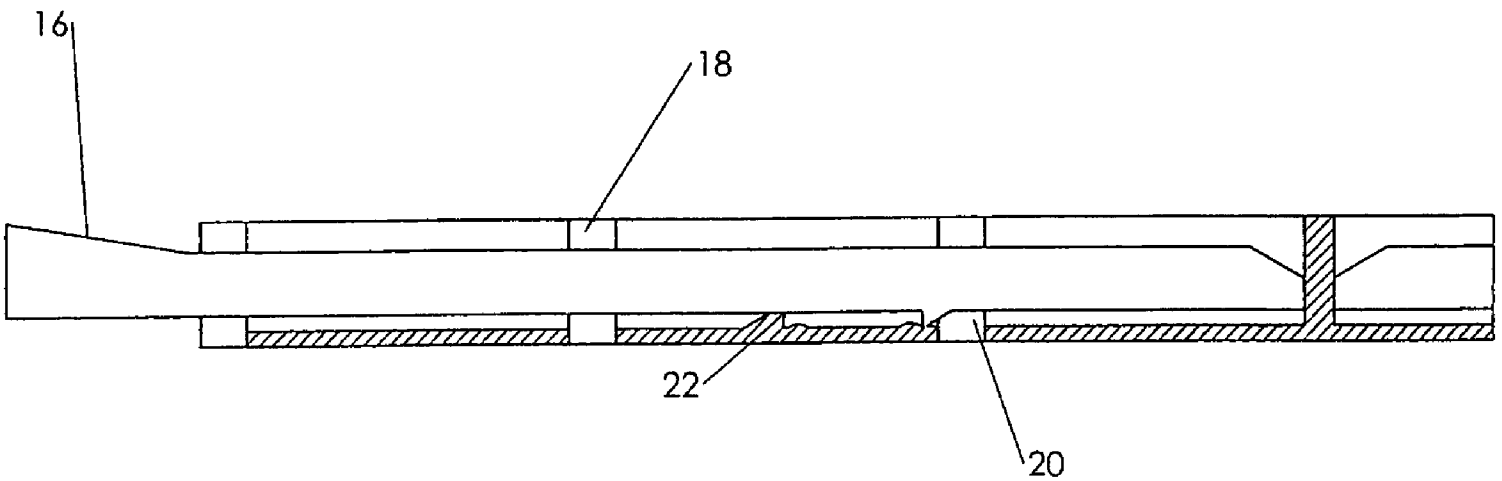
FIG. 9 is a side view of the expanding and contracting mechanism shown in FIG. 8 with the sliding mechanism in a retracted position.
Figure 11:
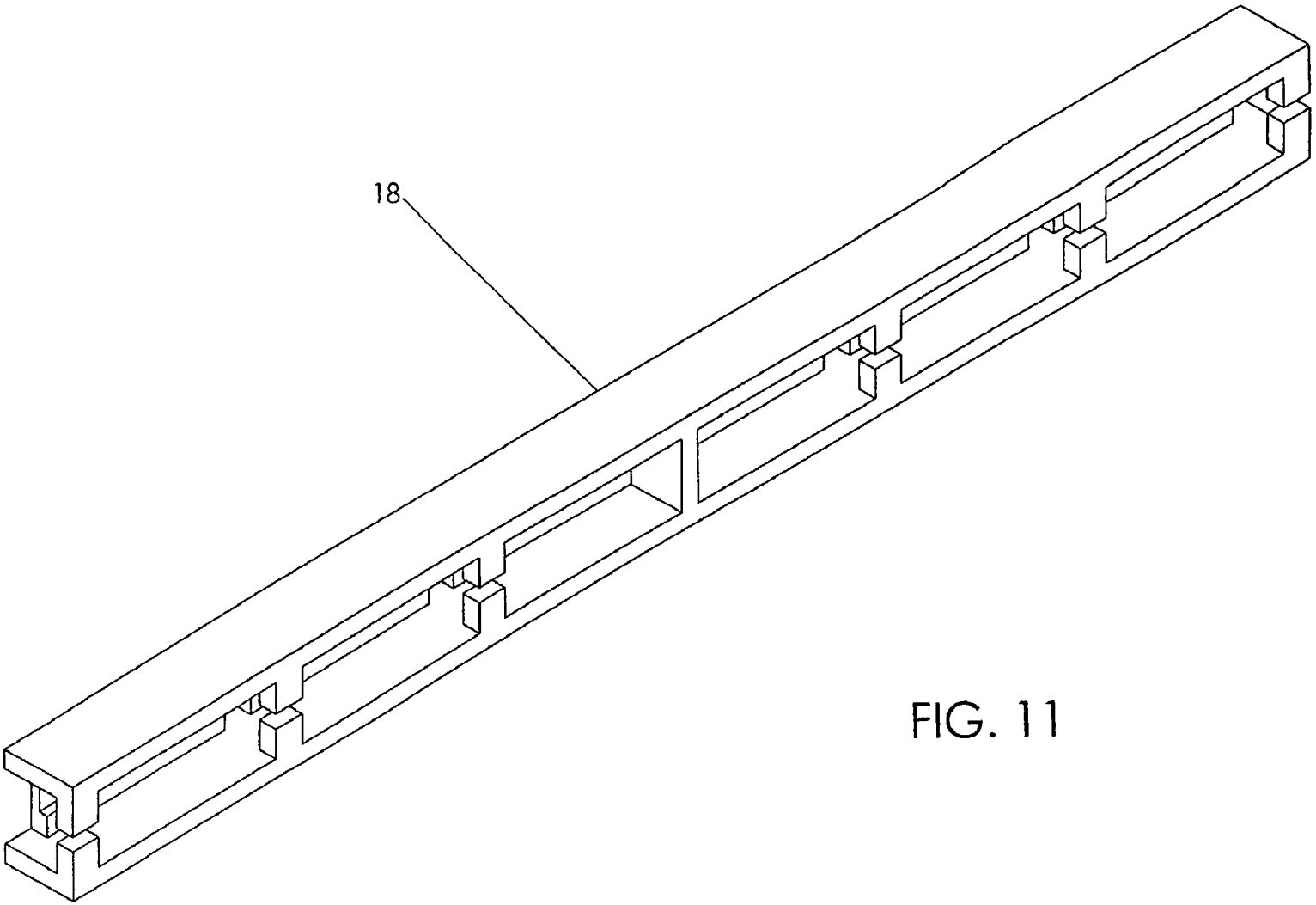
FIG. 11 is a perspective view of the sleeve for the sliding member shown in FIG. 8.

FIGS. 8 and 9 show a pair of sliding members 16 received in a common sleeve 18. FIG. 11 shows a perspective view of a sleeve 18 which may receive a pair of sliding members 16 from opposing sides of the display device.

Figure 10:
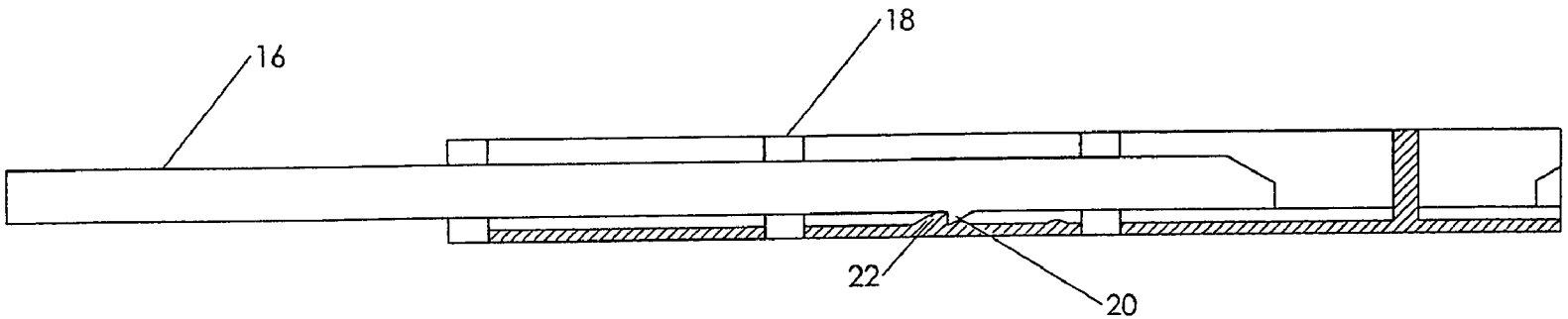
FIG. 10 is a side view of the embodiment of FIG. 8 with the sliding and retracting member in an expanded position.

As shown in FIGS. 9 and 10, sliding members 16 may includes a stop 20 projecting outwardly from an outer surface of the sliding member 16. Sleeve 18 may include a projection 22 disposed on an inner surface of the sleeve 18. Stop 20 is adapted to engage an associated projection 22 for preventing a lateral movement of sliding member 16 beyond a selected point. For example, stop 20 may comprise a substantially triangular shaped projection having an angled portion and a substantially vertical portion. A travel of stop 20 is limited by projections 22, so that sliding member 16 is movable from a retracted position (shown in FIG. 9) and an expanded position (shown in FIG. 10) and the lateral movement of sliding member 16 is delimited by the spacing between projections 22.

Accordingly, while several embodiments of the present invention have been shown and described, it is obvious that many changes and modifications may be made thereunto without departing from the spirit and scope of the invention.

What is claimed is:

1. A display device for displaying and dispensing tubular items of merchandise, the display device comprising:

a) a first side;

b) a second side arranged substantially parallel to said first side and spaced apart from said first side by a distance, wherein one or both of said first side and said second side are movable between a retracted position and an expanded position for accommodating a plurality of sizes of the tubular items of merchandise;

c) a base disposed between said first side and said second side, said base forming a bottom portion of the display device;

d) a cover disposed between said first side and said second side, said cover forming a top portion of the display device;

e) a first ramp having a first width, said first ramp disposed between and spaced apart from said first side and said second side, said first ramp sloping downwardly toward a rear portion of the display device;

f) a second ramp having a second width, said second ramp disposed between and spaced apart from said first side and said second side, at least a portion of said second ramp disposed under said first ramp and sloping downwardly toward a front portion of the display device;

g) a sliding member, said sliding member comprising an elongated rod projecting outwardly from said first side or said second side; and h) a sleeve disposed on said first ramp or said second ramp and adapted to receive said sliding member, wherein said sliding member is laterally movable in said sleeve for moving said first side or said second side between said retracted position and said expanded position and wherein said sleeve spaces said first ramp or said second ramp apart from said first side and said second side wherein each of said first width and said second width is less than said distance between said first side and said second side and wherein said first ramp and said second ramp contact only a cylindrical central body portion of the tubular items of merchandise due to a spaced apart arrangement of said first ramp from said first side and said second side and of said second ramp from said first side and said second side, thereby facilitating a movement of the tubular items of merchandise in the display device.

2. The display device according to claim 1 wherein a first ratio of said first width to said distance between said first side and said second side and a second ratio between said second width to said distance between said first side and said second side are each in the range of approximately 0.2-1.0 to 0.8-1.0 in said retracted position.

3. The display device according to claim 2, wherein said first ratio of said first width to said distance between said first side and said second side and said second ratio between said second width to said distance between said first side and said second side are each in the range of approximately 0.4-1.0 to 0.6-1.0 in said retracted position.

4. The display device according to claim 1 wherein a first ratio of said first width to said distance between said first side and said second side and a second ratio between said second width to said distance between said first side and said second side are each in the range of approximately 0.1-1.0 to 0.6-1.0 in said expanded position.

5. The display device according to claim 4, wherein said first ratio of said first width to said distance between said first side and said second side and said second ratio between said second width to said distance between said first side and said second side are each in the range of approximately 0.3-1.0 to 0.5-1.0 in said expanded position.

6. The display device according to claim 1, wherein said sliding member further comprises a stop projecting outwardly from an outer surface of said sliding member, said stop adapted to engage an associated projection disposed on an inner surface of said sleeve for preventing a lateral movement of said sliding member beyond a selected point.

7. The display device according to claim 1, further comprising a drawer pivotally coupled to the display device and movable between a closed position and an open position for loading the tubular items of merchandise into the display device.

8. A display device for displaying and dispensing tubular items of merchandise, the display device comprising:

a) a first side;

b) a second side arranged substantially parallel to said first side and spaced apart from said first side by a distance;

wherein one or both of said first side and said second side are movable between a retracted position and an expanded position for accommodating a plurality of sizes of the tubular items of merchandise;

c) a base disposed between said first side and said second side, said base forming a bottom portion of the display device;

d) a cover disposed between said first side and said second side, said cover forming a top portion of the display device;

e) a first ramp having a first width, said first ramp disposed between and spaced apart from said first side and said second side, said first ramp sloping downwardly toward a rear portion of the display device;

f) a second ramp having a second width, said second ramp disposed between and spaced apart from said first side and said second side, at least a portion of said second ramp disposed under said first ramp and sloping downwardly toward a front portion of the display device, wherein each of said first width and said second width is less than said distance between said first side and said second side and wherein said first ramp and said second ramp contact only a cylindrical central body portion of the tubular items of merchandise due to a spaced apart arrangement of said first ramp from said first side and said second side and of said second ramp from said first side and said second side, thereby facilitating a movement of the tubular items of merchandise in the display device;

g) a first sliding member comprising a first elongated rod projecting outwardly from said first side;

h) a second sliding member comprising a second elongated rod projecting outwardly from said second side, said first sliding member and said second sliding member forming a first sliding member pair;

i) a third sliding member comprising a third elongated rod projecting outwardly from said first side;

j) a fourth sliding member comprising a fourth elongated rod projecting outwardly from said second side, said third sliding member and said fourth sliding member forming a second sliding member pair;

k) a first sleeve disposed on said first ramp, said first sleeve adapted to receive said first sliding member and said second sliding member and said first sleeve spacing said first ramp apart from said first side and said second side; and l) a second sleeve disposed on said second ramp, said second sleeve adapted to receive said third sliding member and said fourth sliding member and said second sleeve spacing said second ramp apart from said first side and said second side;

wherein said first sliding member and said second sliding member are laterally movable in said first sleeve and said third sliding member and said fourth sliding member are laterally movable in said second sleeve for moving at least one of said first side and said second side between said retracted position and said expanded position.

* * * * *